US008386066B2

(12) United States Patent
Hofbauer et al.

(10) Patent No.: US 8,386,066 B2
(45) Date of Patent: Feb. 26, 2013

(54) METHOD FOR SUPPRESSING THE INFLUENCE OF ROLL ECCENTRICITIES

(75) Inventors: Josef Hofbauer, Erlangen (DE); Martin Niemann, Erlangen (DE); Bernhard Weisshaar, Herzogenaurach (DE); Dietrich Wohld, Rauschenberg (DE)

(73) Assignee: Siemens Aktiengesellschaft, München (DE)

( * ) Notice: Subject to any disclaimer, the term of this patent is extended or adjusted under 35 U.S.C. 154(b) by 663 days.

(21) Appl. No.: 12/224,243

(22) PCT Filed: Jan. 11, 2007

(86) PCT No.: PCT/EP2007/050248

§ 371 (c)(1),
(2), (4) Date: Jan. 13, 2009

(87) PCT Pub. No.: WO2007/096204

PCT Pub. Date: Aug. 30, 2007

(65) Prior Publication Data

US 2009/0210085 A1 Aug. 20, 2009

(30) Foreign Application Priority Data

Feb. 22, 2006 (DE) ..... 10 2006 008 574

(51) Int. Cl.
*G06F 19/00* (2006.01)

(52) U.S. Cl. ..... 700/156; 700/148; 700/150; 700/152; 700/155; 72/8.3; 72/365.2; 72/10.1; 72/148; 72/7.2; 72/9.2; 72/238; 72/7.4; 72/8.6; 72/8; 29/33 Q; 29/33 S; 29/894.354; 29/893.32; 29/81.03; 425/328

(58) Field of Classification Search ..... 700/156, 700/148, 150, 152, 155; 72/8.3, 28.2, 30.2, 72/10.1; 425/328; 29/81.3, 893.32, 894.354, 29/33 S, 33 Q
See application file for complete search history.

(56) References Cited

U.S. PATENT DOCUMENTS 3,100,410 A 8/1963 Hulls et al.

(Continued)

FOREIGN PATENT DOCUMENTS

DE 1 809 639 7/1969
DE 19839286 B4 12/2004

(Continued)

OTHER PUBLICATIONS

EPO, "machine translation of EP 1627695", Feb. 2006, pp. 8.*

(Continued)

*Primary Examiner* — Jeffrey A Gaffin
*Assistant Examiner* — Olvin Lopez Alvarez

(57) ABSTRACT

The invention relates to a method for suppressing the influence of roll eccentricities on the run-out thickness of a rolled stock, which runs through a rolling stand, roll eccentricities being identified by using a process model and taken into consideration in the determination of a correction signal for at least one final control element, preferably a final control element for the adjustment position, of the rolling stand, wherein the measured tensile force upstream of the rolling stand is fed to the process model to identify the roll eccentricities. According to the invention, variations in tensile force are fed back in a targeted manner to reduce the effects of periodic roll eccentricities on the rolled stock, whereas all other sources of variation are eliminated. A process model of the rolling nip and the rolls, preferably based on the observer principle, produces reliable data on the roll eccentricity.

13 Claims, 3 Drawing Sheets

U.S. PATENT DOCUMENTS

| | | | | | |
|---|---|---|---|---|---|
| 4,126,027 | A | * | 11/1978 | Smith et al. | 72/13.4 |
| 4,398,254 | A | * | 8/1983 | Kondo et al. | 700/155 |
| 4,656,854 | A | * | 4/1987 | Stewart et al. | 72/8.7 |
| 4,685,063 | A | * | 8/1987 | Weihrich et al. | 700/156 |
| 4,691,547 | A | * | 9/1987 | Teoh et al. | 72/9.2 |
| 4,760,723 | A | * | 8/1988 | Nakagawa | 72/8.4 |
| 5,077,997 | A | * | 1/1992 | Wolters et al. | 72/9.2 |
| 5,495,735 | A | * | 3/1996 | Nishimura | 72/8.2 |
| 5,600,982 | A | * | 2/1997 | Berger | 72/9.2 |
| 5,647,237 | A | * | 7/1997 | Jungkunz et al. | 72/9.2 |
| 5,647,238 | A | * | 7/1997 | Steidl et al. | 72/10.1 |
| 5,771,724 | A | * | 6/1998 | Hartung | 72/11.8 |
| 5,809,817 | A | * | 9/1998 | Ginzburg | 72/8.6 |
| 5,833,778 | A | * | 11/1998 | van Kuijeren et al. | 148/601 |
| 5,873,277 | A | * | 2/1999 | Bruestle | 72/7.4 |
| 5,966,682 | A | * | 10/1999 | Gramckow et al. | 702/170 |
| 6,357,301 | B1 | | 3/2002 | Berghs et al. | |
| 7,481,089 | B2 | * | 1/2009 | Valence et al. | 72/238 |
| 2007/0220939 | A1 | * | 9/2007 | Britanik et al. | 72/9.2 |
| 2010/0005844 | A1 | * | 1/2010 | Felkl et al. | 72/7.2 |
| 2010/0211209 | A1 | * | 8/2010 | Meissen et al. | 700/173 |
| 2011/0011143 | A1 | * | 1/2011 | Felkl | 72/8.3 |

FOREIGN PATENT DOCUMENTS

| | | | | |
|---|---|---|---|---|
| EP | 0 170 016 | B1 | | 2/1986 |
| EP | 0 698 427 | B1 | | 2/1986 |
| JP | 04200915 | A | | 7/1992 |
| JP | 9-248608 | | * | 9/1997 |

OTHER PUBLICATIONS

IEEE, "Active Compensation of Roll Eccentricity in Rolling Mills", 2000, pp. 625-632.*

ABB, "Control for Cold rolling Mills", downloaded on 2011, pp. 4.*

ISIJ international, "Analysis of the effect of tension at the Entry of cold rolling Mill on the Stability of Strip Tracking", 2005, vol. 45 No. 9, pp. 1316-1321.*

Dictionary.com, "define: describe", 2011, pp. 3.*

JP 9-248608, "Machine Translation", Sep. 1997, pp. 12.*

* cited by examiner

METHOD FOR SUPPRESSING THE INFLUENCE OF ROLL ECCENTRICITIES

CROSS REFERENCE TO RELATED APPLICATIONS

This application is the U.S. National Stage of International Application No. PCT/EP2007/050248, filed Jan. 11, 2007 and claims the benefit thereof. The International Application claims the benefits of German application No. 10 2006 008 574.4 filed Feb. 22, 2006, both of the applications are incorporated by reference herein in their entirety.

FIELD OF INVENTION

The invention relates to a method for suppressing the influence of roll eccentricities on the run-out thickness of a rolling stock item, which passes through a rolling stand, roll eccentricities being identified by the use of a process model and being taken into account in the determination of a correction signal for at least one control device for a final control element of the rolling stand.

BACKGROUND OF THE INVENTION

Rolling stands frequently incorporate roll eccentricities, caused for example by inaccurately worked support rolls or by imprecise mounting of the support rolls, which adversely affect the quality of the rolled strip, the roll eccentricities being expressed in the strip with the rotational speed of the rolls affected by eccentricity, normally the support rolls, depending on the stiffness of the rolling stand and the rolling stock. The frequency spectrum of the eccentricities and of the disruptions in the strip caused by them essentially contains the fundamental frequencies of the top and bottom support rolls; but higher harmonic oscillations are also present, although they frequently only make an appearance at a reduced amplitude. Due to slightly different diameters and rotational speeds of the upper and lower support rolls, the frequencies assigned to the support rolls may diverge from each other.

EP 0 170 016 B1 discloses a method of the type referred to in the introduction, where the influence of roll eccentricities in the position or thickness regulation of rolling stands is compensated for, the roll eccentricities being identified on the basis of a measurement of the rolling force in the rolling stand. Oil pressure sensors are normally used for measuring the rolling force, the measured values from which sensors are distorted to a considerable degree by friction effects. This means that no adequately reliable and effective suppression of the influence of roll eccentricities can be effected with the aid of the measuring instruments. More reliable and more accurate measuring methods for the rolling force are too costly and too complex.

An approach known from EP 0 698 427 B1, in a method for suppressing the influence of roll eccentricities, is to use the run-out thickness of the rolling stock instead of the rolling force as a measured value. Thickness sensors are very costly, however, and therefore, in the case of multi-stand rolling mills, are normally only provided upstream and downstream of the first rolling stand and downstream of the last one.

A method for suppressing the influence of roll eccentricities on the run-out thickness of a rolling stock item is known from U.S. Pat. No. 4,656,854 A, where the rolling stock item passes through a rolling stand. Roll eccentricities are identified by the use of a process model and taken into account in the determination of a correction signal for a control device for a final control element of the rolling stand. For the purposes of identifying the roll eccentricities, measured values for the tensile force prevailing in the rolling stock item are fed to the process model.

A similar disclosure can be found in JP 04 200 915 A.

SUMMARY OF INVENTION

The object of the invention is to provide a method for suppressing the influence of roll eccentricities that avoids the disadvantages known from the prior art and in particular those described in the foregoing.

The object is achieved by a method for suppressing the influence of roll eccentricities on the run-out thickness of a rolling stock item with the features of the claims. Advantageous embodiments of this method form the subject matter of the dependent claims.

The object underlying the invention is also achieved by means of a computer program product in accordance with the claims.

BRIEF DESCRIPTION OF THE DRAWINGS

In the following, further advantages and details of the invention are described by way of example and with reference to the drawings. These show.

DETAILED DESCRIPTION OF INVENTION

Figure 1:
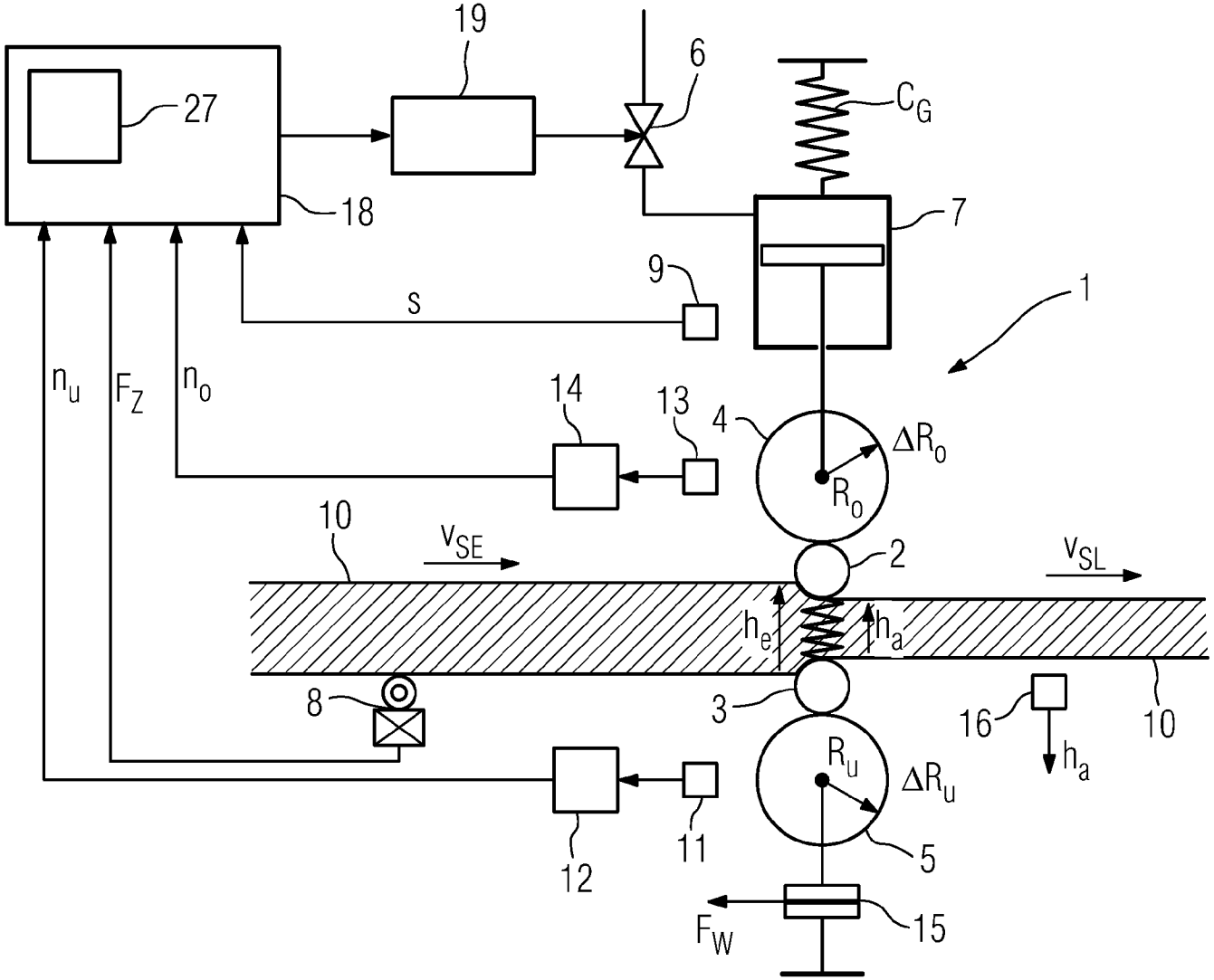
FIG. 1 A rolling stand in conjunction with a regulating device with a process model, FIG. 2 A schematic representation of the observer principle used for identifying the roll eccentricities, FIG. 3 The coupling of the tension measurement to the process model, FIG. 4 A run-in thickness compensation mechanism for the measured values used.

FIG. 1 shows, in schematic form and by way of example, a rolling stand 1 of a rolling mill for rolling a rolling stock item 10. A rolling mill for rolling a rolling stock item 10 has one or more rolling stands 1 of this type. A further rolling stand 1, a coiler device, a cooling device, and/or some other device, e.g. for thermal and/or mechanical influencing of the rolling stock item and/or a facility for transporting the rolling stock item 10 can be provided upstream or downstream of a rolling stand 1. The rolling stock item 10 is preferably a strip, a section, a wire or a slab. For example, the rolling stock item 10 can be a metal strip, by way of example a steel strip, a non-ferrous metal strip or an aluminum strip.

A rolling stand 1 has at least one top support roll 4 with a radius $R_o$ and at least one bottom support roll 5 with a radius $R_u$. The rolling stand 1 shown has at least one top work roll 2 and at least one bottom work roll 3, the diameter of a work roll 2 or 3 respectively normally being smaller than the diameter of a support roll 4 or 5 respectively. In the example shown, a hydraulic screwdown device 7 capable of being operated via a control valve 6 is provided for regulating the screwdown position of the rolling stand 1. Alternatively or additionally, an electromechanical screwdown system can also be provided. The screwdown device 7 or the screwdown system, which is not represented in detail, are used for adjusting the roll screwdown s. The hydraulic screwdown is supported on the stand frame. The elastic stand frame is represented symbolically by means of a spring with the spring constant $C_G$.

A rolling stock item 10 passes through the rolling stand 1, the thickness of the rolling stock item 10 being reduced from the run-in thickness $h_e$ to the run-out thickness $h_a$ with the aid of the work rolls 2, 3 upon passing through the rolling nip. The rolling stock item 10, to which an equivalent material defect with the spring constant $C_M$ is assigned in the rolling nip, passes into the rolling nip with the run-in speed $v_{SE}$ and leaves the rolling nip with the run-out speed $v_{SL}$.

The roll eccentricities of the top support roll 4 or the bottom support roll 5 may have their origin in uneven roll wear, deformations due to thermal stresses, and/or the divergences between the geometrical cylinder axes of the rolls and the rotational axes becoming established in operation. The roll eccentricities are designated by $\Delta R_o$ and $\Delta R_u$, i.e. as divergences from the ideal support roll radiuses $R_o$ and $R_u$.

The measurement of the roll rotational speed $n_o$ or $n_u$ of the top or the bottom support roll 4 or 5 is used for determining the fundamental mode of oscillation of the roll eccentricities. Given the simplifying preconditions that the top and bottom rolls of the rolling stand 1 rotate equally quickly, it is sufficient to capture the rotational speed just of a driven roll, e.g. the bottom work roll 3, by using a revolution counter 11.

If, as in most cases, the support rolls 4 and 5 are the rolls that are affected by eccentricity, the measured rotational speed of the work roll 2 or 3 is converted into the rotational speed $n_o$ or $n_u$ of the support roll 4 or 5 via the relationship of the diameter of the work roll 2 or 3 to the diameter of the support roll 4 or 5 in at least one conversion unit 14 or 12. Since the rotational speeds of the top rolls 4, 2 and the bottom rolls 5, 3 are normally different due to slightly varying diameters, both a revolution counter 13 above the rolling stock item 10 and also a revolution counter 11 below the rolling stock item 10, with a conversion unit 14 or 12 positioned downstream in each case, are provided for capturing the rotational speed $n_o$ or $n_u$ in the exemplary embodiment shown.

The roll screwdown s is measured with a position detector 9 on the screwdown device 7 or on the screwdown system respectively. The roll screwdown s is fed to a regulating device 18. For the purposes of identifying and suppressing roll eccentricity, the regulating device 18 is fed at least one roll rotational speed $n_o$ or $n_u$. Furthermore, a tension measuring device 8 is provided upstream of the rolling stand 1 for measuring the tensile force $F_Z$. The tension measuring device 8 can have, as indicated in FIG. 1, a measuring roller for measuring tension. This measuring roller can preferably be embodied in a segmented manner. The tension measuring device 8 can also be embodied as a non-contacting tension measuring device. A corresponding facility for contactless measurement of the tensile force $F_Z$ in a rolling stock item embodied as a metal strip is disclosed in DE 198 39 286 B4 for example.

For the purposes of identifying and/or suppressing roll eccentricities, a regulating device 18 has a process model 27. The process model 27 is based on an observer and models the behavior of the rolling nip and the rolls. In this respect, the process model 27 is run with the aid of the roll speed, i.e. for example with the aid of the roll rotational speeds determined $n_o$ and $n_u$ in frequency terms. The time profile of the disruptions to be modeled is indeed periodic but not purely sinusoidal. That is to say the oscillation to be modeled is made up of a fundamental mode of oscillation and a plurality of higher oscillations.

In the process model 27, sinusoidal correction target values assigned to the eccentricity frequencies are calculated for a final control element of the rolling stand 1 with the matching phase position and amplitude for the position of the rolling nip regulation. As shown in FIG. 1, the correction target values can be given to the screwdown device 7 or to a screwdown system via a control device 19 and where relevant via a control valve 6. Through the use of the measured tensile force $F_Z$, the required strip thickness, i.e. the run-out thickness $h_a$ of the rolling stock item 10 can be adjusted extremely evenly with the aid of the regulating device 18. Divergences in thickness caused by the roll eccentricity $\Delta R_o$ or $\Delta R_u$ can be avoided in this way.

Alternatively or additionally it is possible, for example, to measure the rolling force $F_W$ by using a pressure sensor 15 and to take it into account in the identification and suppression of roll eccentricities.

By using a thickness gauge 16, it is alternatively or additionally possible to measure the thickness of the rolling stock item 10, for example the run-out thickness $h_a$.

Figure 2:
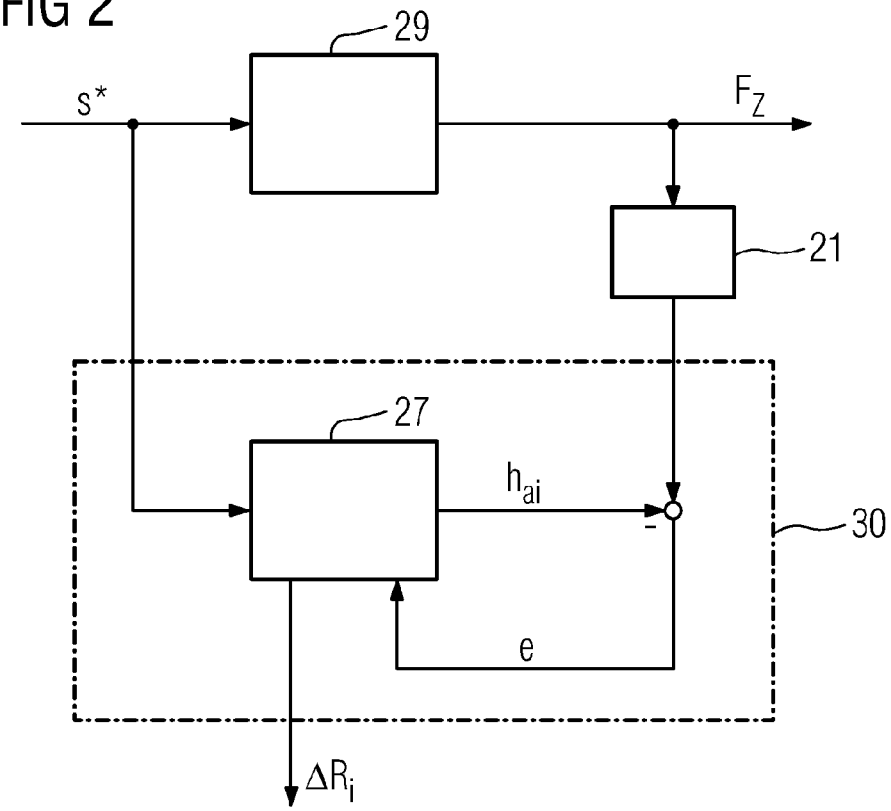

FIG. 2 shows, in schematic form and by way of example, the structure in accordance with the observer principle used for identifying roll eccentricities. In this respect, a target value s* for the screwdown position is fed both to a real process 29, such as e.g. takes place in a rolling stand 1 through which a rolling stock item 10 passes (see FIG. 1), and also to an observer module 30. The observer module 30 has a process model 27, with the aid of which roll eccentricities can be identified and with the aid of which the identified roll eccentricities $\Delta R_i$ can be made available for compensation purposes. With the aid of the process model 27, an identified run-out thickness $h_{ai}$ can preferably be determined, which can be combined with the measured tensile force $F_Z$ for determining an observer error e. In this respect, the measured tensile force $F_Z$ is fed initially to a module 21 in the measuring channel which takes inverse account of the transfer behavior from the run-out thickness up to the drawing of the strip. With the aid of the module 21, the measured value for the tensile force $F_Z$ is in this way converted to the run-out thickness and compared with the identified run-out thickness $h_{ai}$ determined with the aid of the process model 27. The difference resulting from this comparison forms the observer error e. The states of the process model 27 are corrected by taking account of the observer error e until the measurement and the model agree at least very largely and the observer error e is sufficiently small or zero. Then the roll eccentricities $\Delta R_i$ identified in the process model 27 also agree with the roll eccentricities actually present in the rolling stand 1 (see FIG. 1). The identified roll eccentricities $\Delta R_i$ determined in this way by the observer module 30 enable an extremely reliable and accurate compensation of eccentricity.

Figure 3:
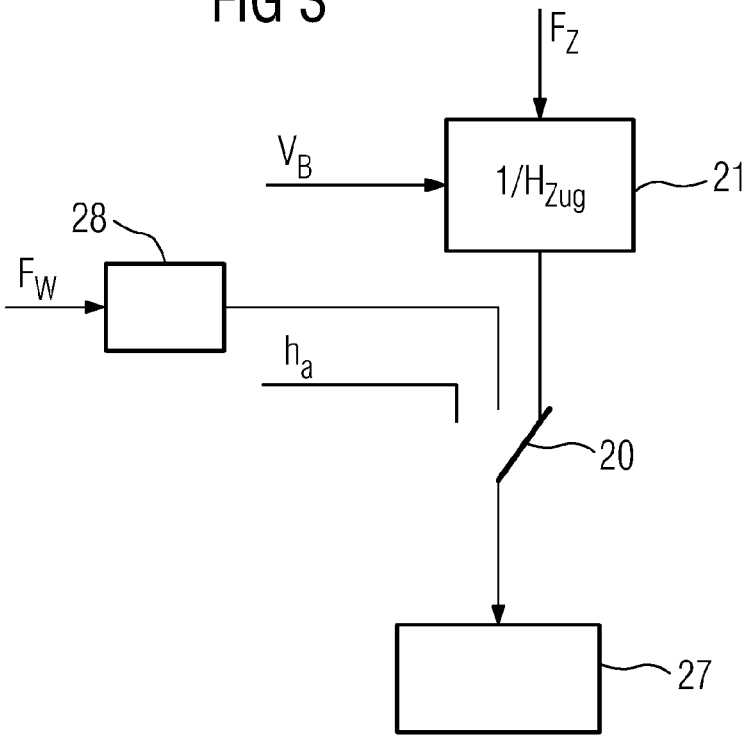

As represented in the example shown in FIG. 3, a selection can be effected by using a change-over switch 20, as to whether the process model is to take account of the run-out thickness $h_a$, the rolling force $F_W$ or the tensile force $F_Z$ in the identification of roll eccentricities.

FIG. 3 shows by way of example how the transfer behavior from the screwdown position up to the drawing of the strip can be taken into account in the use of the tensile force $F_z$ for identifying and suppressing roll eccentricities. Thus a module 21 is preferably provided in the measuring channel in the example shown, which takes inverse account of the transfer behavior from the run-out thickness up to the drawing of the strip. In this respect, the measured values for the tensile force $F_Z$ are preferably combined with the corresponding transfer function $F_{Zug}$. This can be effected for example by means of multiplication by a factor which corresponds to the inverse transfer function $H_{Zug}$. Additionally, an adaptive circuit can be provided which takes account of the dependency on the strip speed $v_B$. Preferably, the value present at the output of the module 21, which was determined with the aid of the tensile force $F_Z$, is fed to the process model 27.

As can also be seen from the example represented in FIG. 2, the process model 27 preferably reproduces the behavior of the process 29 from the screwdown position s or from the target value s* for the screwdown position up to the run-out thickness $h_a$. If, alternatively or additionally to the tensile force $F_Z$, the rolling force $F_W$ is to be taken into account in the process model 27, it is appropriate to provide a module 28 in the measuring channel for the rolling force $F_W$ which has a suitable transfer characteristic.

Figure 4:
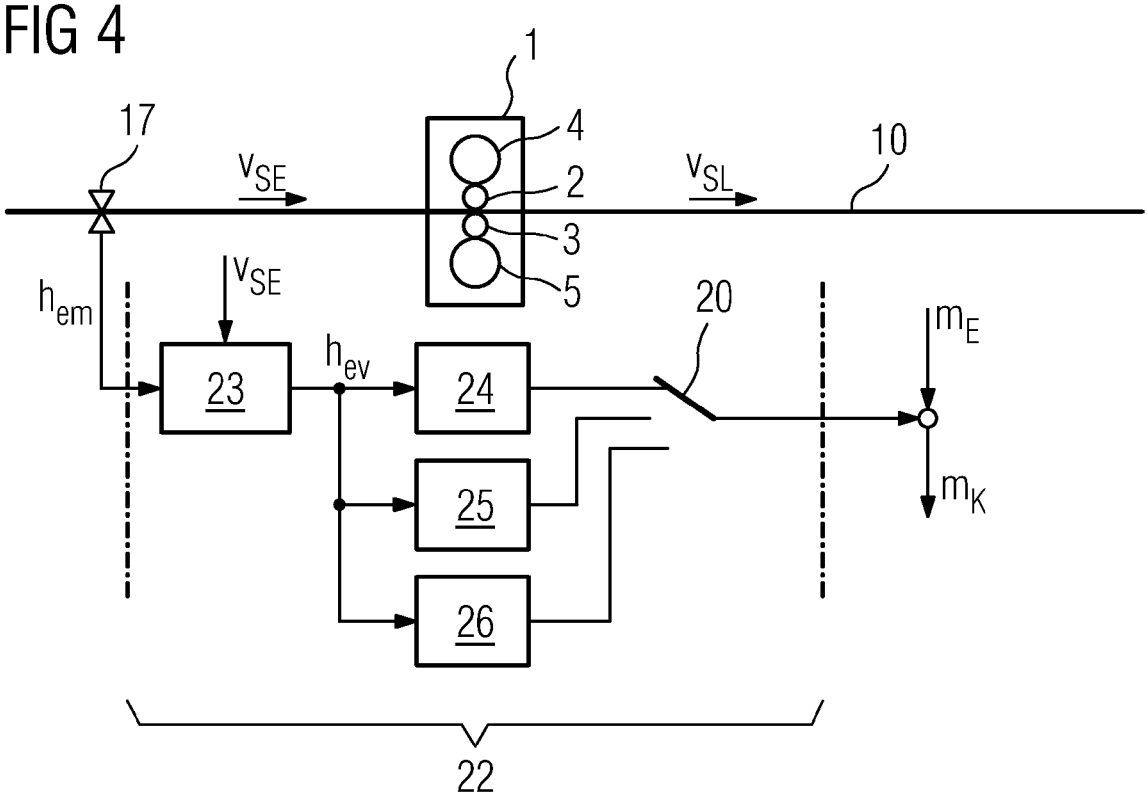

FIG. 4 shows an example of the use of a run-in thickness compensation mechanism in conjunction with the method according to the invention. In this respect, a thickness gauge 17 is provided upstream of the rolling stand, with the aid of which gauge a measured run-in thickness $h_{em}$ is captured. The illustrated run-in thickness compensation module 22 has a strip tracking module 23. With the aid of the strip tracking module 23, the measured run-in thickness $h_{em}$ is positionally tracked into the rolling stand 1. With the aid of the run-in speed $v_{SE}$, a positionally tracked run-in thickness $h_{ev}$ is determined. The strip tracking module 23 preferably operates in a model-based manner.

In the example shown, the run-in thickness compensation module 22 has at least one compensation model 24, 25, 26, with the aid of which, as a function of the measured variable $m_E$ used or the corresponding measured value, the influence of the run-in thickness $h_e$ on the run-out thickness $h_a$ is determined. Since the quality of the run-in thickness compensation is essentially dependent on the compensation model or models 24, 25, 26 used, one compensation model 24 is provided for the use of the run-out thickness $h_a$ as the measured variable $m_E$, one compensation model 25 for the use of the rolling force $F_W$ as the measured variable $m_E$, and one compensation model 24 for the use of the tensile force $F_Z$ as the measured variable $m_E$ in the example shown. The compensation signal produced by the run-in thickness compensation module 22 is combined with the corresponding measured value for the measured variable $m_E$ to form a compensated measured variable $m_K$.

An essential idea underlying the invention can be summarized as follows.

The invention relates to a method for suppressing the influence of roll eccentricities on the run-out thickness $h_a$ of a rolling stock item 10, which passes through a rolling stand 1, roll eccentricities being identified by the use of a process model 27 and being taken into account in the determination of a correction signal for at least one final control element, preferably a final control element for the screwdown position, of the rolling stand 1, the measured tensile force $F_Z$ upstream of the rolling stand 1 being fed to the process model 27 to identify the roll eccentricities. According to the invention, fluctuations in tensile force are fed back in a targeted manner to reduce the effects of periodic roll eccentricities on the rolling stock item 10, whereas all other sources of fluctuation are eliminated. The process model 27 of the rolling nip and the rolls, which is based on the observer principle, generates, e.g. with the aid of the measured tensile force $F_Z$, the roll screwdown s, and the roll speed or the roll rotational speed, reliable data on the roll eccentricities. According to the invention, specified dimensions of the rolling stock item 10 are achieved more uniformly than previously. Tension measuring devices 8 operate very accurately and dynamically in comparison with measuring devices for the thickness $h_e$ or $h_a$ of the rolling stock item 10, and in comparison with measuring devices for the rolling force $F_W$. Preferably, the periodic oscillation components contained within the tensile force fluctuation and caused by the roll eccentricity are used in a deliberate manner to reduce the undesirable alteration in thickness in the rolling stock item 10 caused by eccentricity. Fluctuation components with other frequencies not equal to the eccentricity frequencies are not reacted to.

Periodic fluctuations in thickness stemming from the run-in thickness with frequencies that are virtually equal to the eccentricity frequencies can disrupt the identification of the roll eccentricities. Consequently, a run-in thickness compensation mechanism can be provided, which determines and compensates for the influence of the run-in thickness fluctuations on the measured variable $m_E$ used and in this way eliminates this type of disruption.

The tension regulators present in known regulating arrangements of a rolling mill embodied as a tandem mill, for example, can prevent part of the effects on the thickness caused by the eccentricities only in the case of low roll speed and only at the front stands of the tandem mill due to their limited dynamics. A regulating device 18 embodied according to the invention for suppressing the influence of roll eccentricities, to which the tensile force $F_Z$ measured at the rolling stock item 10 is fed, can take over the compensation of the eccentricity frequencies at a rolling stand 1 and therefore completely take the load off conventional tension regulators.

The invention claimed is:

1. A method for suppressing the influence of roll eccentricities on a run-out thickness of a rolling stock item, that passes through a rolling stand having a support roll, a work roll and a screwdown device operable for regulating a screwdown position of the rolling stand, comprising:

measuring a tensile force value prevailing in the rolling stock item;

measuring a rotational speed value of one of the rolls;

measuring a thickness value of the rolling stock item;

determining a screwdown position of the screwdown device;

converting the tensile force value to a run-out thickness;

comparing the run-out thickness based on the tensile force value with a run-out thickness determined with a process model;

identifying the roll eccentricities via the process model;

effecting a run-in thickness compensation; and generating a correction signal for at least one control device for a final control element of the rolling stand.

2. The method as claimed in claim 1, wherein the tensile force is measured upstream of the rolling stand.

3. The method as claimed in claim 2, wherein a model is used which describes the screwdown position of the rolling stand as a function of tensile force prevailing in the rolling stock item.

4. The method as claimed in claim 3, wherein a target value for the screwdown position is fed to the model, the model determines an identified run-out thickness by taking account of the identified roll eccentricities, a run-out thickness of the rolling stock item is determined based on the captured tensile force, an observer error is determined based on the difference between the identified run-out thickness determined based on the model and the run-out thickness determined based on the captured tensile force, the observer error is fed to the model, the roll eccentricities are corrected based on the observer error, until the observer error is sufficiently small or zero.

5. The method as claimed in claim 4, wherein the measured values for the tensile force are fed to a module which takes inverse account of a transfer behavior of the tensile force prevailing in the rolling stock item.

6. The method as claimed in claim 5, wherein a dependency on the strip speed is taken into account in an adaptive manner.

7. The method as claimed in claim 6, wherein the process model models at least a rolling nip and the rolls of the rolling stand.

8. A computer program product comprising a non-transitory computer usable medium having computer readable program code embodied therein for execution on a data processing system, to implement a method for suppressing the influence of roll eccentricities on a run-out thickness of a rolling stock item, that passes through a rolling stand having a support roll, a work roll and a screwdown device operable for regulating a screwdown position of the rolling stand, the method comprising:

receiving a measured tensile force value that prevail in the rolling stock item into a process model of the program;

receiving a measured value of rotational speed of one of the rolls, a measured value of a thickness of the rolling stock item and determination of a screwdown position of the screwdown device;

converting the measured tensile force value to determine a run-out thickness;

comparing the run-out thickness based on the tensile force value with a run-out thickness determined with a process model;

identifying the roll eccentricities via the process model; and effecting a run-in thickness compensation; and generating a correction signal for at least one control device for a final control element of the rolling stand.

9. The computer program product as claimed in claim 8, wherein the model used describes the screwdown position as a function of tensile force prevailing in the rolling stock item.

10. The computer program product as claimed in claim 9, wherein a target value for the screwdown position is fed to the model, the model determines an identified run-out thickness by taking account of the identified roll eccentricities, a run-out thickness of the rolling stock item is determined based on the captured tensile force, an observer error is determined based on the difference between the identified run-out thickness determined based on the model and the run-out thickness determined based on the captured tensile force, the observer error is fed to the model, the roll eccentricities are corrected based on the observer error, until the observer error is sufficiently small or zero.

11. The computer program product as claimed in claim 10, further comprising a module which takes inverse account of a transfer behavior of the tensile force prevailing in the rolling stock item.

12. The computer program product as claimed in claim 11, wherein a dependency on the strip speed is taken into account in an adaptive manner.

13. The computer program product as claimed in claim 12, wherein the process model models at least a rolling nip and the rolls of the rolling stand.

* * * * *